US007926208B2

(12) United States Patent
Cavada

(10) Patent No.: US 7,926,208 B2
(45) Date of Patent: Apr. 19, 2011

(54) FAST HEAT/FAST COOL IRON WITH STEAM BOILER

(75) Inventor: Luis Cavada, Miami, FL (US)

(73) Assignee: Applica Consumer Products, Inc., Miramar, FL (US)

( * ) Notice: Subject to any disclaimer, the term of this patent is extended or adjusted under 35 U.S.C. 154(b) by 1102 days.

(21) Appl. No.: 11/673,708

(22) Filed: Feb. 12, 2007

(65) Prior Publication Data

US 2008/0189993 A1 Aug. 14, 2008

(51) Int. Cl.
*D06F 75/38* (2006.01)
*D06F 75/08* (2006.01)

(52) U.S. Cl. ..... 38/93

(58) Field of Classification Search ..... 38/74, 77.1, 38/77.6–77.83, 77.9, 81, 88, 93; 219/245
See application file for complete search history.

(56) References Cited

U.S. PATENT DOCUMENTS

| | | | | |
|---|---|---|---|---|
| 1,010,092 | A | 11/1911 | Thomas | |
| 1,237,726 | A | 8/1917 | Taylor | |
| 1,347,224 | A | 7/1920 | Kako | |
| 1,472,185 | A * | 10/1923 | Mollenhauer | 219/520 |
| 2,138,720 | A * | 11/1938 | Wright | 38/74 |
| 2,142,032 | A | 12/1938 | Matsen | |
| 2,179,890 | A | 11/1939 | Kaplan | 219/25 |
| 2,222,327 | A | 11/1940 | Walkup | 219/25 |
| 2,257,451 | A * | 9/1941 | Barnes | 38/74 |
| 2,357,905 | A | 9/1944 | Olving | 219/25 |
| 2,889,439 | A * | 6/1959 | Musgrave | 392/435 |
| 2,928,194 | A | 3/1960 | Maykemper | 38/77 |
| 3,098,922 | A | 7/1963 | Paxton | 219/25 |
| 3,263,350 | A | 8/1966 | Abraham | 38/77 |
| 3,663,798 | A | 5/1972 | Speidel et al. | 219/464 |
| 3,869,596 | A * | 3/1975 | Howie | 219/438 |
| 3,906,187 | A | 9/1975 | Turoczi, Jr. | 219/254 |
| 4,089,128 | A | 5/1978 | Baumgartner et al. | 38/93 |
| 4,122,615 | A | 10/1978 | Baumgartner et al. | 38/93 |
| 4,207,456 | A | 6/1980 | Best | 219/345 |
| D262,771 | S | 1/1982 | Hanson | D32/70 |
| 4,602,143 | A | 7/1986 | Mack et al. | 219/225 |
| 4,642,922 | A | 2/1987 | Prudenziati | 38/81 |
| 4,835,363 | A | 5/1989 | Hoffmann | 219/258 |

(Continued)

FOREIGN PATENT DOCUMENTS

CA 2477750 A1 7/1997

(Continued)

OTHER PUBLICATIONS

International Search Report and the Written Opinion. PCT/US2008/053282, 15 pages, Jun. 24, 2008.

(Continued)

*Primary Examiner* — Ismael Izaguirre
(74) *Attorney, Agent, or Firm* — Armstrong Teasdale LLP

(57) ABSTRACT

A method and device for controlling the temperature of a soleplate of an iron, the method having the following steps: energizing a heater element associated with the soleplate, wherein heat energy is transferred from the heater element to the soleplate; and heating the soleplate from 60° C. to a temperature of greater than 100° C. in less than 45 seconds. A method and device for controlling an iron, the method having the following steps: setting a soleplate of the iron to a first temperature; and setting a steam boiler of the iron to a second temperature, wherein the first and second temperatures are different.

51 Claims, 8 Drawing Sheets

U.S. PATENT DOCUMENTS

| | | | | | |
|---|---|---|---|---|---|
| 4,856,212 | A | | 8/1989 | Dikoff | 38/93 |
| 4,857,702 | A | | 8/1989 | Cafaro | 219/225 |
| 4,860,434 | A | * | 8/1989 | Louison et al. | 29/611 |
| D314,459 | S | | 2/1991 | Littmann | D32/70 |
| 5,042,179 | A | * | 8/1991 | van der Meer | 38/77.83 |
| 5,094,021 | A | | 3/1992 | Chen | 38/82 |
| 5,105,525 | A | | 4/1992 | Firalti et al. | 29/527.3 |
| D335,010 | S | | 4/1993 | Vildosola | D32/68 |
| 5,279,054 | A | * | 1/1994 | Chasen | 38/77.7 |
| 5,380,983 | A | | 1/1995 | Cavada et al. | 219/250 |
| 5,392,542 | A | | 2/1995 | Chang | 38/93 |
| D364,950 | S | | 12/1995 | Classen | D32/70 |
| D369,004 | S | | 4/1996 | Reibl | D32/70 |
| D369,005 | S | | 4/1996 | Stützer et al. | D32/70 |
| D369,890 | S | | 5/1996 | Reibl | D32/70 |
| D373,870 | S | | 9/1996 | Reibl | D32/70 |
| 5,642,579 | A | * | 7/1997 | Netten et al. | 38/77.7 |
| 5,664,349 | A | | 9/1997 | White et al. | 38/97 |
| D388,574 | S | | 12/1997 | Clouet | D32/70 |
| D389,627 | S | | 1/1998 | Stützer et al. | D32/70 |
| 5,777,297 | A | * | 7/1998 | Gelus et al. | 219/254 |
| 5,780,812 | A | | 7/1998 | Klinkenberg | 219/251 |
| 5,799,422 | A | | 9/1998 | Demuth et al. | 38/93 |
| 5,864,122 | A | * | 1/1999 | Brandolini et al. | 219/483 |
| D406,933 | S | | 3/1999 | Leverrier | D32/70 |
| 5,886,322 | A | | 3/1999 | Mendoza et al. | 219/256 |
| 5,937,552 | A | | 8/1999 | Hall | 38/93 |
| 5,979,089 | A | | 11/1999 | Bouleau et al. | 38/77.83 |
| D418,648 | S | | 1/2000 | Gudefin | D32/70 |
| D418,649 | S | | 1/2000 | Stützer et al. | D32/70 |
| D421,324 | S | | 2/2000 | McIntyre | D32/71 |
| D427,403 | S | | 6/2000 | Gudefin | D32/70 |
| D431,339 | S | | 9/2000 | Stutzer et al. | D32/70 |
| D433,551 | S | | 11/2000 | Powell | D32/70 |
| D435,325 | S | | 12/2000 | Stützer et al. | D32/70 |
| D436,704 | S | | 1/2001 | Stützer et al. | D32/70 |
| D441,157 | S | | 4/2001 | Powell | D32/70 |
| D441,931 | S | | 5/2001 | Powell | D32/71 |
| D443,122 | S | | 5/2001 | Yang | D32/70 |
| D457,996 | S | | 5/2002 | Figur et al. | D32/70 |
| 6,437,292 | B1 | | 8/2002 | Sikka et al. | 219/441 |
| D464,780 | S | | 10/2002 | Schupp | D32/70 |
| D470,636 | S | | 2/2003 | Bas | D32/70 |
| D472,354 | S | | 3/2003 | Figur et al. | D32/70 |
| D478,401 | S | | 8/2003 | Lee | D32/70 |
| D480,524 | S | | 10/2003 | Wendt | D32/69 |
| D480,525 | S | | 10/2003 | Wendt | D32/70 |
| D481,186 | S | | 12/2003 | Powell | D32/70 |
| D488,275 | S | | 4/2004 | Gudefin | D32/70 |
| 6,785,989 | B2 | * | 9/2004 | Rienzo et al. | 38/77.1 |
| D502,791 | S | | 3/2005 | Garner et al. | D32/70 |
| 6,953,912 | B2 | | 10/2005 | Alday et al. | 219/251 |
| D515,762 | S | | 2/2006 | Kihara | D32/70 |
| D516,764 | S | | 3/2006 | Kihara | D32/70 |
| D516,765 | S | | 3/2006 | Lee | D32/71 |
| D519,699 | S | | 4/2006 | Lee | D32/71 |
| D529,249 | S | | 9/2006 | Bas et al. | D32/70 |
| 7,472,504 | B2 | * | 1/2009 | Yu et al. | 38/77.8 |
| 7,516,566 | B2 | * | 4/2009 | Yu | 38/77.83 |
| 7,610,701 | B2 | * | 11/2009 | Cavada | 38/82 |
| 2002/0029498 | A1 | | 3/2002 | Harrison et al. | 38/75 |
| 2002/0148824 | A1 | | 10/2002 | Hauf et al. | 219/411 |
| 2003/0177672 | A1 | * | 9/2003 | Lukas et al. | 38/74 |
| 2004/0026398 | A1 | * | 2/2004 | Wehrwein et al. | 219/229 |
| 2006/0156592 | A1 | | 7/2006 | Zhang et al. | 38/93 |
| 2006/0179692 | A1 | | 8/2006 | Lin et al. | 38/89 |
| 2006/0263074 | A1 | | 11/2006 | Xing | 392/407 |

FOREIGN PATENT DOCUMENTS

| | | | |
|---|---|---|---|
| DE | 19634870 | C1 | 10/1997 |
| EP | 0281987 | A1 | 3/1988 |
| EP | 0438673 | A1 | 12/1990 |
| FR | 2543180 | | 9/1984 |
| FR | 0 681 052 | A1 | 4/1995 |
| GB | 2163459 | A | 2/1986 |
| WO | WO 03/046272 | A1 | 6/2003 |

OTHER PUBLICATIONS

Kapton Material Offers Strength, Tear Resistance and Stability, Watlow Electric Manufacturing Company, 2 pages, 2001.

* cited by examiner

FAST HEAT/FAST COOL IRON WITH STEAM BOILER

TECHNICAL FIELD

The present disclosure relates generally to the field of irons used to remove wrinkles from fabrics, in particular, heated soleplate irons that generate steam.

BACKGROUND

Irons have been used to remove wrinkles from fabrics for many years. Some conventional irons may have relied on a large mass or heat sink to deliver and maintain sufficient temperature for the ironing process. Currently a large mass of metal is casted to form the shape of a soleplate in the iron. This large mass, will take some time to heat up, and a very long time to cool. Times to heat up can be about two minutes, and to cool down as long as 40 minutes.

Within this mass, there may be a chamber where steam is generated for the aid of wrinkle removal. A steam generator may have been included within the soleplate for the realization of steam in the ironing process. Typically the heat source used to heat the soleplate is also used to boil fluid for steam generation. When using the soleplate at a low temperature, while the steam operation is enabled, there may be incidence of water droplets being released by the soleplate. In this case, there may not be enough heat/energy in the soleplate to do the ironing operation as well as to generate steam.

SUMMARY

According to one embodiment of the present disclosure, there is provided a method for controlling the temperature of a soleplate of an iron, the method having the following steps: energizing a heater element associated with the soleplate, wherein heat energy is transferred from the heater element to the soleplate; and heating the soleplate from room temperature to a temperature of greater than 100° C. in less than 45 seconds.

Another embodiment of the present disclosure provides a method for controlling an iron, the method having the following steps: setting a soleplate of the iron to a first temperature; and setting a steam boiler of the iron to a second temperature, wherein the first and second temperatures are different.

According to another embodiment of the present disclosure, there is provided a device for removing wrinkles from fabric, the device having: a soleplate comprising a thickness less than 1.6 mm; and a heater element associated with the soleplate so as to heat the soleplate.

A further embodiment of the present disclosure provides a device for removing wrinkles from fabric, the device having: a soleplate comprising a steam hole; a soleplate heater element associated with the soleplate so as to primarily heat the soleplate; a steam boiler in fluid communication with the steam hole of the soleplate; and a boiler heater element associated with the steam boiler so as to primarily heat the steam boiler.

BRIEF DESCRIPTION OF THE DRAWINGS

Some embodiments of the disclosure may be understood by referring, in part, to the following description and the accompanying drawings, in which like reference numbers refer to the same or like parts and, wherein.

DETAILED DESCRIPTION OF THE DRAWING

Selected embodiments of the disclosure may be understood by reference, in part, to FIGS. 1-6, wherein like numbers refer to same and like parts. The present disclosure relates to irons used to remove wrinkles from fabrics, in particular, heated soleplate irons that generate steam and those that include the option to dry iron (no steam use).

Figure 1:
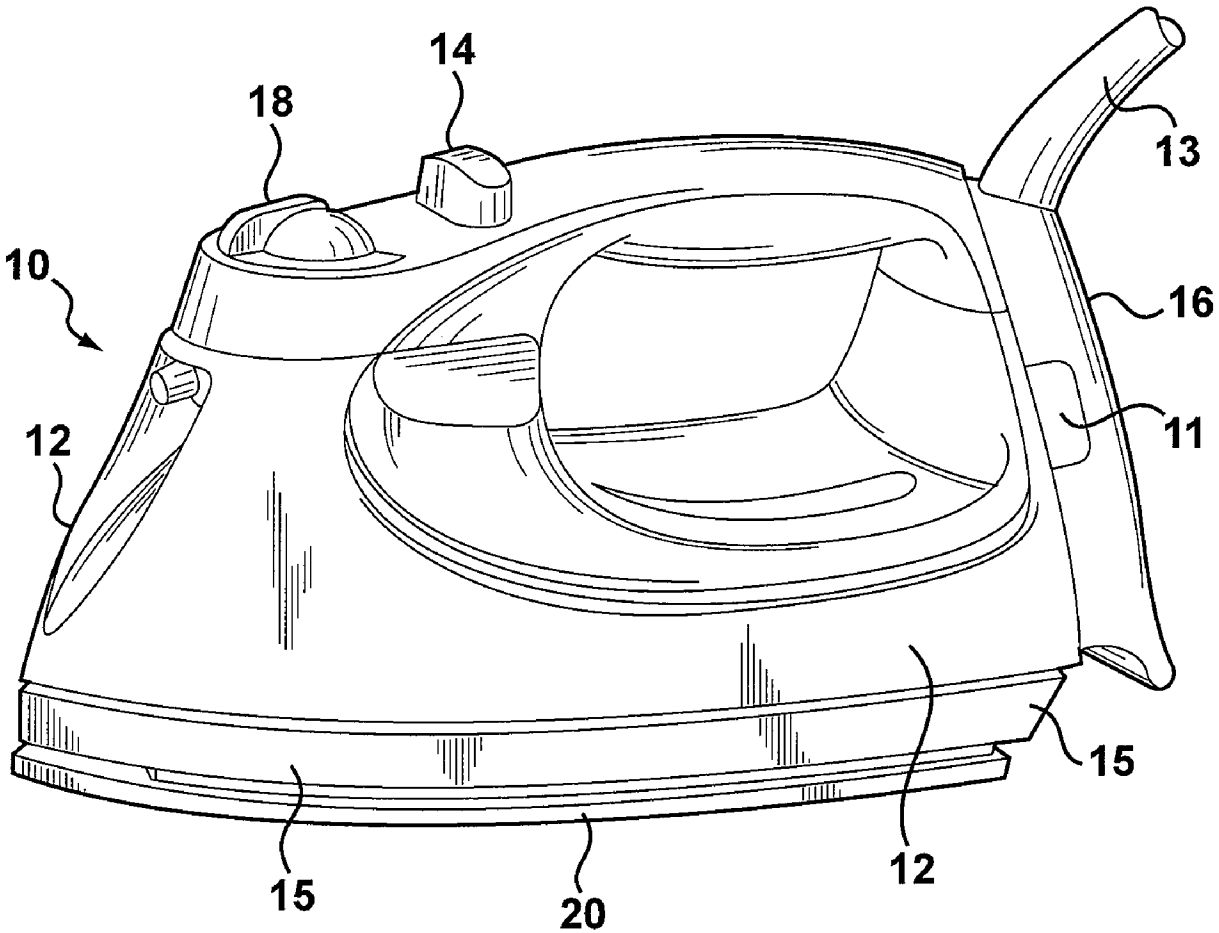
FIG. 1 illustrates a perspective view of an iron of the present invention.

Referring to FIG. 1, there is shown a perspective view of an electric steam iron 10 incorporating features of the present invention. Although the present invention will be described with reference to a few embodiments shown in the drawings, it should be understood that features of the present invention can be embodied in many alternative forms of alternate embodiments. In addition, any suitable size, shape, or type of elements or materials could be used.

Iron 10 generally comprises housing 12 with a rear cover 16, soleplate 20, heat insulating skirt 15, temperature control knob 18, steam surge button 14, reset button 11, and electric cord 13. However, features of the present invention could be incorporated into other types of irons and other types of electrical appliances. The control knob 18 may be connected to a thermostat (not shown) inside the housing 12. Alternatively, thermostat may be omitted and all thermistor feedback of temperature for a boiler and soleplate may be accomplished with micro controls appropriate for temperatures based on user selection. Temperature control for the boiler may also be by using a thermistor. A fixed temperature of 200 deg C. setting, may be changed to a variable setting later in the program. Steam rate may be changed by volume of water provided to boiler. The thermostat may be mounted on soleplate 20. In an alternative embodiment of the invention (not shown), two control knobs are implemented: one for controlling the temperature of a soleplate, and one for controlling the temperature of a steam boiler. Reset button 11 may be attached to rear cover 16 and rear cover 16 may house an electronic module (not shown). In other embodiments, there is no reset button, but rather, there may be an ON/OFF switch, or a shake-to-start sensor and switch. Depending on the particular embodiment, the iron may comprise an auto-OFF module that has circuitry adapted to automatically turn iron 10 OFF after a predetermined period of time, such as one hour. Reset button 22 is adapted to depress an actuator of the module to reset the module. In alternate embodiments, any suitable type of electronic module or control could be used. In some embodiments, there may be no reset button. Iron may have an ON/OFF switch or a motion sensor which when activated will turn unit on (if plugged into AC). Heat insulating skirt 15 may be attached to soleplate 20. Skirt 15 may have electrical terminals positioned within skirt 15 for electrical communication with a heater in soleplate 20. Also, in certain embodiments, a steam boiler (not shown in FIG. 1) is positioned within skirt 15.

Figures 2A, 2B:
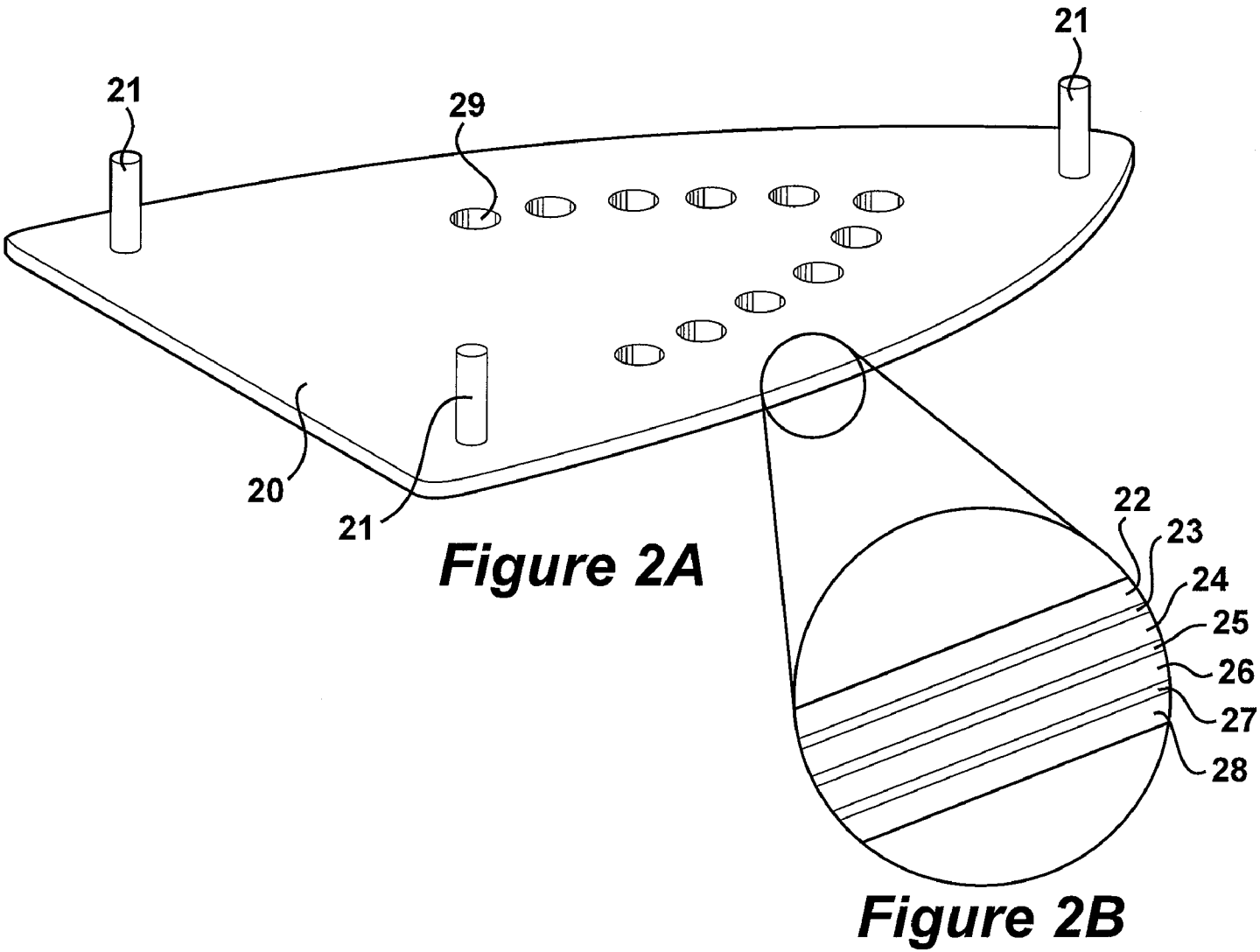
FIG. 2A illustrates a perspective view of a soleplate embodiment of the invention.
FIG. 2B illustrates a cross-sectional, side view of layers forming the soleplate shown in FIG. 2A.

Referring to FIGS. 2A and 2B, a perspective view of a soleplate and an enlarged view of the edge of the soleplate are shown. Soleplate 20 is a generally flat structure that provides a contact surface for pressing fabric materials. Soleplate 20 has three mounting pegs 21 for securing the soleplate to heat insulating skirt 15 and housing 12. Any number of pegs may be used to secure the soleplate. A plurality of steam holes 29 may extend through a midsection of the soleplate. The steam holes may be in any configuration and/or pattern sufficient to communicate steam from steam boiler 30 to fabrics being ironed. Soleplate 20 may be a multi-layered structure comprising a heater element and ironing plate. As shown in the enlarged view of FIG. 2B, soleplate 20 comprises several layers of material in the following order: first insulating film 22, first adhesive layer 23, heater element 24, second adhesive layer 25, second insulating film 26, third adhesive layer 27, and ironing plate 28.

Figure 3:
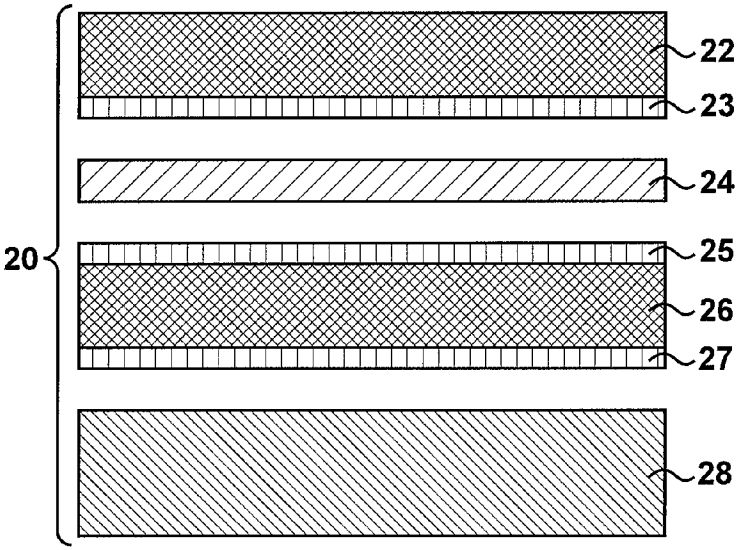
FIG. 3 illustrates another cross-sectional side view of one embodiment of a soleplate.

Referring to FIG. 3, a cross-sectional, side view is shown of portions of pre-assembly components of a soleplate of the present invention. First insulating film 22 has first adhesive layer 23 applied to its lower surface before it is assembled with the other soleplate components. Similarly, second insulating film 26 has second adhesive layer 25 pre-applied to its top surface and third adhesive layer 27 is pre-applied to its bottom surface. The soleplate is assembled by a series of steps. In a first step, adhering second insulating film 26 to ironing plate 28 by third adhesive layer 27. In a second step, adhering heater element 24 to second insulating film 26 by second adhesive layer 25. In a third step, adhering first insulating film 22 to heater element 24 by first adhesive layer 23. Alternatively, the steps may be accomplished in a different order.

Figure 4:
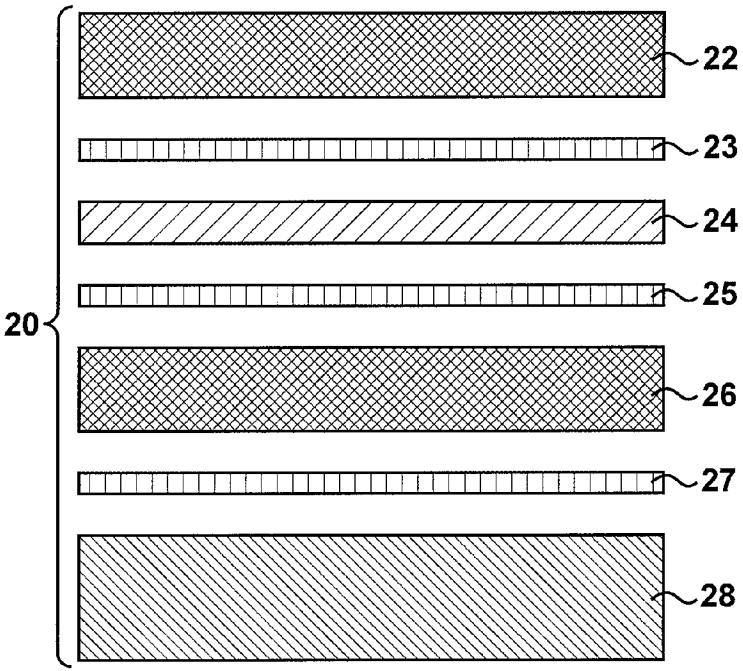
FIG. 4 illustrates another cross-sectional side view of one embodiment of a soleplate.

Referring to FIG. 4, a cross-sectional, side view is shown of portions of pre-assembly components of a soleplate of the present invention. While the components are similar to those described relative to FIG. 3, they differ in that the adhesive films are not pre-applied. The soleplate is assembled by a series of steps. In a first step, applying third adhesive layer 27 to ironing plate 28 and adhering second insulating film 26 to ironing plate 28 by third adhesive layer 27. In a second step, applying second adhesive layer 25 to second insulating film 26 and adhering heater element 24 to second insulating film 26 by second adhesive layer 25. In a third step, applying first adhesive layer 23 to adhering heater element 24 and adhering first insulating film 22 to heater element 24 by first adhesive layer 23.

Figure 5:
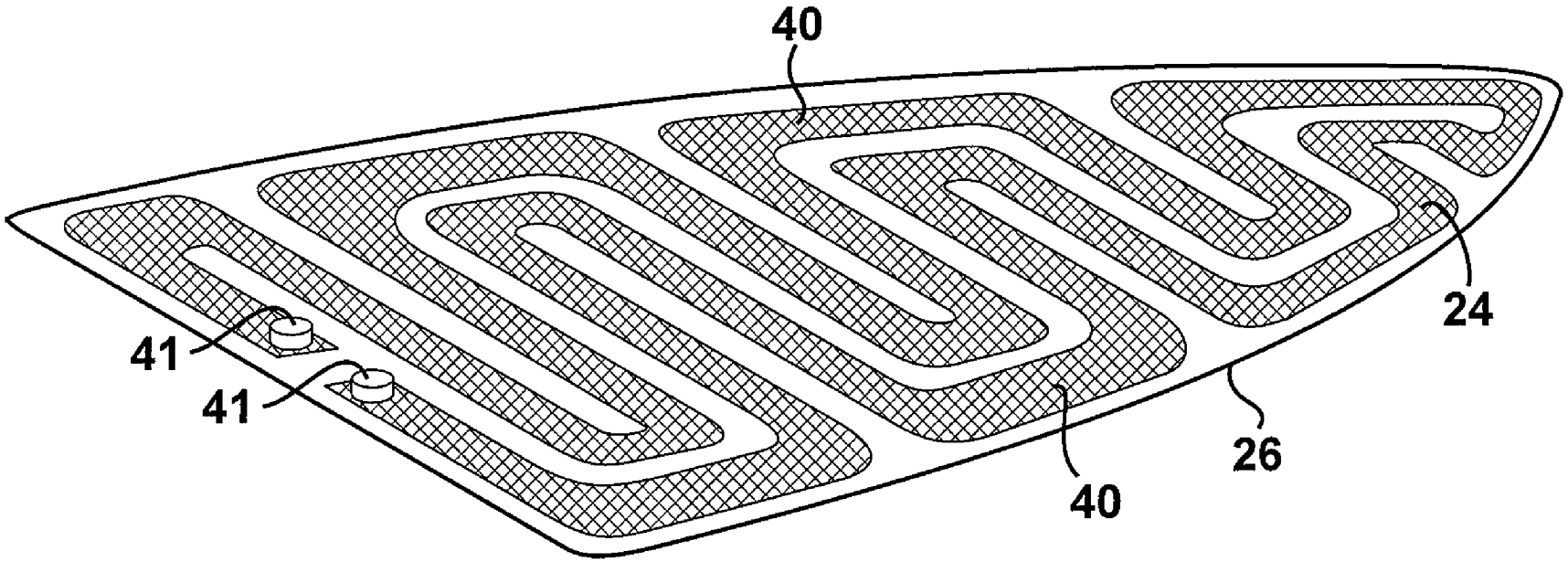
FIG. 5 illustrates a perspective view of a heater element embodiments of the invention.

Referring to FIG. 5, a perspective view of a heater element is shown adhered to an insulating film. This illustrative heater element 24 comprises two side-by-side undulating metal foil strands 40 that connect for form one continuous electrically resistant heat generating coil that is adhered to insulating film 26. Strands can vary in size/thickness to allow different watt densities in a particular area. The metal foil strands 40 include input terminals 41 at the ends of the metal foil strands 40. Heater element 24 may be a flat strip or tape of metallic resistance material, whose flat sides engage on the insulation. The tape thickness may be smaller than ⅙ and preferably smaller than 1/20 of the width. The thickness may be 0.05 to 0.15 mm, while the width may be 1 to 5 mm. The resistance material may be any known electrically resistive material, including all conventional iron-based materials, e.g. a chrome-aluminum-iron alloy, such as is known under the trade name Kanthal AF or a nickel-chrome-iron alloy, known under the trade name Kanthal Nicrothal.

The electrically conductive material of heater element 24 may be a metal such as aluminum or silver and may be in the form of dust if it is provided as the filling of a conductive adhesive. The conductive material layer may be made transparent for example by the use of indium-tin-oxide or a like transparent conductive material. Making the heater element 24 transparent may increase the thermal emissivity of the thermal soleplate. Heater element 24 may be a thin vacuum deposited or painted-on metallic layer or it could be replaced by a relatively thick metal, e.g. aluminum, sheet (not shown).

In one embodiment, the heater element 24 may be an etched foil design element comprising circuitry for a Kapton®/Polyimide heater. The heater element may be constructed of a material that is a polyimide polymer, for example, a Kapton® material. Note that Kapton® is a trademark of the DuPont™ Corporation. A Kapton® material, in film form, can provide enhanced dielectric strength in very thin cross sections and very good bonding and heat transfer capabilities. Use may be made of a Kapton® film having a thermal conductivity below 0.5 W/mK and a dielectric strength exceeding 1250 V, which can be achieved with a thickness between 0 and 100 μm. The heater can therefore be implemented as a Kapton® type heater. Note that resistive heater element 24 of FIG. 5 may be implemented as a Kapton® type heater or a heater formed of a polyimide polymer, depending upon design considerations.

Kapton®/Polyimide heaters made with this DuPont™ thin film may be transparent, lightweight, flexible and are electrically strong. Kapton®/Polyimide may be compatible with foil element alloys such as inconel, nickel, copper, and stainless steel. They may have low outgassing properties, may be resistant to solvents. They may work well with adhesive systems that permit higher operating temperatures. Thermal control and sensing devices may be incorporated into the soleplate. Heater elements according to the present invention may have a relatively longer life than traditional tubular heaters (calrods).

The soleplates shown in FIG. 2 may comprise a thin outer layer of Kapton® (first insulating film 22) and a thicker layer of Kapton® (second insulating film 26) between which two layers there is a layer of electrically conductive material (heater element 24). The layer of electrically conductive material could be formed by vacuum depositing a layer of conductive material onto the second insulating layer 26 and then bonding the first insulating film 22 to the layer 26 by way of layers of adhesive material. Adhesive layers may be painted onto the insulating film layers.

Heater element 24 may be a deposited ink on a dielectric that is bonded to a metal substrate. Once energized, the conductive inks may provide the heat source to elevate the soleplate temperature. The ink pattern may be two side-by-side undulating ink deposit strands similar to the strands 40 shown in FIG. 5. Of course, the ink strands connect for form one continuous electrically resistant heat generating ink coil that is bonded to a metal substrate.

Figure 6:
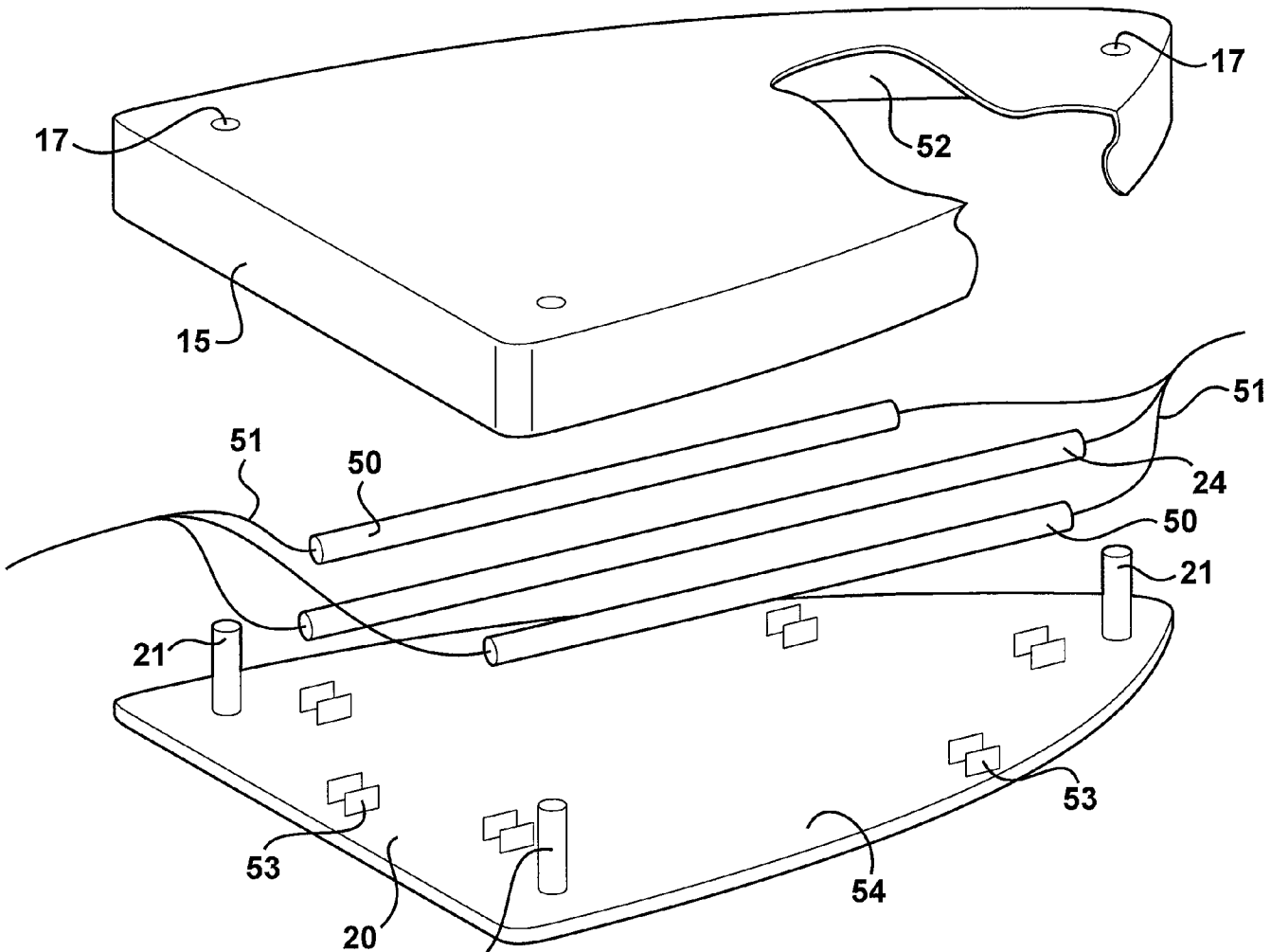
FIG. 6 illustrates an exploded, perspective view of soleplate, heater element, and heat insulating skirt embodiments of the invention.

Referring to FIG. 6, an exploded perspective view of a soleplate, heater element and heat insulating skirt are shown. Soleplate 20 has three or more mounting pegs mounting pegs 21 for engagement with mounting holes 17 in heat insulating skirt 15. Heater element 24 for soleplate 20 may be an infrared source of the type which is energized very quickly. As shown in the FIG. 6 example, heater element 24 comprises three infrared quartz tubes 50, wherein the quartz tube 50 positioned in the middle of soleplate 20 is relatively longer than the two quartz tubes 50 positioned at the sides so as to accommodate the shape of soleplate 20. Any number of tubes may be positioned in any pattern. Further, the tubes may take any shape, for example, linear, arcuate, angled, figure C, figure 8, figure S, square, circular, etc. Quartz tubes 50 have electrical leads 51 for electrically communicating with temperature control knob 18 and electric cord 13 (see FIG. 1). Tube clips 53 may be mounted to soleplate 20 for engagement with quartz tubes 50. Tube clips 53 may suspend quartz tubes 50 over soleplate 50 so as to disperse energy more evenly to soleplate 20. The interior surfaces of heat insulative skirt 15 may be coated with an infrared reflective coating 52 to reflect energy emitted by quartz tubes 50 toward soleplate 20. Examples of reflective coatings or materials include: gold, anodized aluminum or any other high temperature, low emissivity material. Soleplate 20 may also be coated with an infrared absorptive coating 54. Examples of absorptive coatings or materials include: ceramic, porcelain or any other high emissivity material.

The infrared source may be a tungsten type lamp. The infrared source may be used to quickly heat up the thin metal substrate of the soleplate. Due to the metal soleplate being thin, once the infrared source is removed or de-energized, it may cool rapidly. Quartz lamps may also be used. Quartz tubes 50 may have a Watt density between about 65-120 Watts/linear inch. Quartz tubes 50 may also have an internal gold reflector. Quartz tubes and quartz lamps may have the ability to reach maximum temperature very quickly, if not instantly. Further, Quartz tubes and quartz lamps may reach maximum operating temperatures of 870° C. to 1370° C.

In one embodiment of the invention, the Kapton® layer is about 25 μm (0.001 inches) thick, the PFA adhesive is 25 μm (0.001 inches) thick, the etched film heater is 50 μm (0.002 inches) thick, so that the entire soleplate thickness is between about 0.1 mm (0.004 inches) and 1.6 mm (0.064 inches). The soleplate may also be of thicknesses other than that described. Some soleplate embodiment that have thinner dimensions and may be aided by ribs or any other structural support to prevent the thin metal from deforming, particularly once the heater element is energized.

Figure 7:
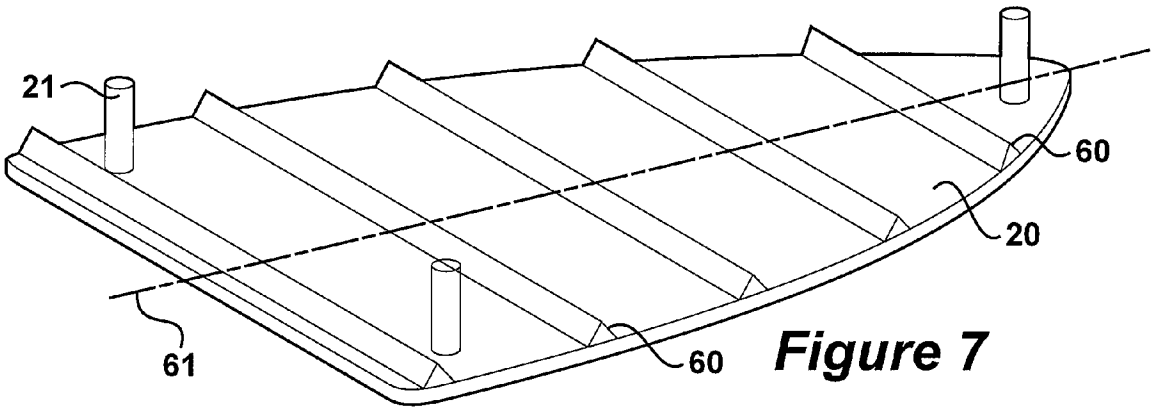
FIG. 7 illustrates a perspective view of soleplate embodiment having ribs.

FIG. 7 is a perspective view of a soleplate embodiment having ribs 60. Any number of ribs 60 may be formed on the backside of soleplate 20 to lend structural support to make soleplate more rigid. As illustrated in FIG. 7, ribs 60 run transverse to longitudinal axis 61. Alternatively, ribs 60 may run parallel to longitudinal axis 61 or at any angle to the axis. Further, rather than straight ribs, the ribs may be curvilinear, circular, etc., and may form any pattern. The ribs may be spaced relative to each other to a sufficient degree to not add significant mass to the soleplate so as not to diminish the soleplate's ability to heat and cool quickly, but they may be spaced relatively close to each other to provide enough structural rigidity to enable the soleplate to generally retain its shape when pressing fabrics. The rib material may be formed within the soleplate material. Made die casted in, or stamping process formed. Ribs 60 may be made of the same material as soleplate 20, or it may be made of different materials.

Figure 8:
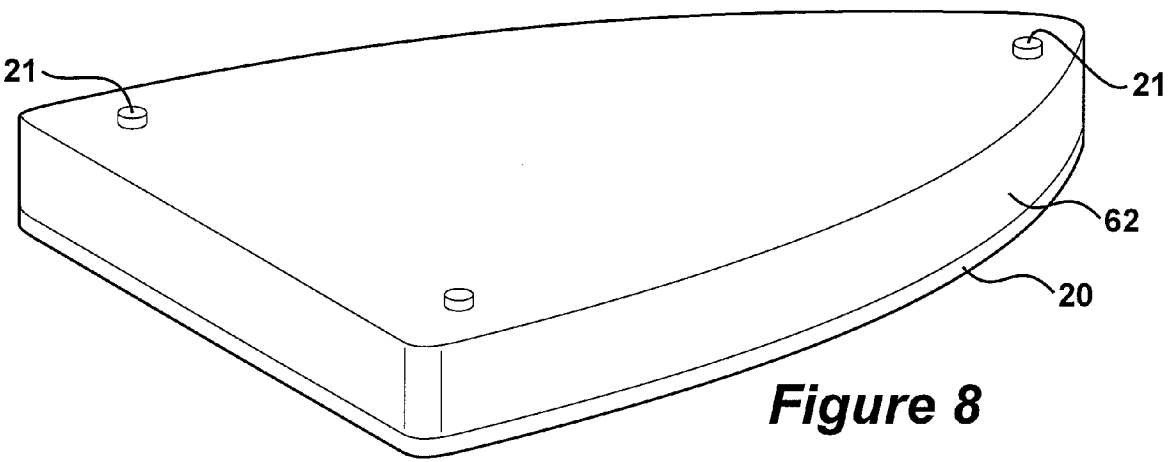
FIG. 8 illustrates a perspective view of soleplate embodiment having a backing.

FIG. 8 illustrates a perspective view of a soleplate embodiment having a backing 62. Backing 62 may be sufficiently rigid to support the relatively thin soleplate 20 when pressing fabrics or performing other operations. Backing 62 may be made of any material sufficiently rigid and able to withstand the high temperatures to which the soleplate may be heated. Further, backing 62 may not absorb the heat energy so that it may not impede the soleplate's ability to heat and cool quickly. The backing may have holes therethrough of any shape, size or pattern. The backing material may be phenolic, BMC (Bulk Molded Compound), or any other high temperature plastic. Any material known to persons of skill may be used as a backing so long as it generally functions as described.

Ironing plate 28 may be made of aluminum, stainless steel, or any material known to persons of skill. The soleplate can be of any good thermally conductive material. Sole plate 20 may be made of various types of stamped metal. For example, it may comprise steel, stainless steel, aluminum or any other suitable thermally conductive material. As technologies advance, newer materials can be used which may improve heat dispersion and ironing performance. As technologies advance, new alloys may be used for the sole plate, in particular, the heater element. Materials that may deliver relatively higher watt densities as well as heat up more evenly and faster may be desirable.

Components of sole plate 20, including heater element, insulating film, adhesive layers, and ironing plate may be manufactured by metal stamping and forming processes. For example, with reference to FIGS. 3 and 4, heater element 24 and insulating films 22 and 26 may initially be adhered via adhesive film layers 23 and 25 (adhesive film 27 may also be added) as large sheets of raw material. After the components have been adhered, one or more sole plates may be stamped from the sandwiched materials. Alternatively, heater element 24, insulating films 22 and 26, and ironing plate 28 may initially be adhered via adhesive film layers 23, 25 and 27 as large sheets of raw material. After the components have been adhered, one or more sole plates may be stamped from the sandwiched materials. Because the components of sole plate 20 are stamped as a unitary subcomponent, there are relatively fewer parts to assemble when electric steam iron 10 is assembled. Sole plates manufactured according to this inventive process may not require die-casting equipment or a die casting facility.

In alternative methods, components of sole plate 20 may be die cast. Steam boiler 30 (see FIG. 10) may be die cast.

According to one embodiment of the invention, the heater element may be mounted directly on a thin soleplate structure comprising metal. The heater element may be thin metallic layer of metal alloy protected by a dielectric insulator on both sides. Sole plate 20 may react very quickly to changes in temperature setting. It may heat up very quickly from room temperature to an ironing temperature of 100° C. or greater in less than 45 seconds. In some embodiments it may heat up to 200° C. in less than 45 seconds Further, sole plate 20 may cool down very quickly, for example, from an ironing temperature to a safe temperature of 60° C. in 4.5 minutes or less. Because new ironing temperatures may be reached quickly, a user may not need to start with low temperature garments and work up to higher temperature garments. 60° C. is considered a safe temperature, no burning or any sort of damage to user or environment. It may be called Cool Touch. A user may change temperature settings for each garment to be ironed.

According to a further embodiment of the invention, sole plate 20 is a relatively low mass structure. Low mass may reduce ironing fatigue. Because sole plate 20 has low mass, sole plate 20 may be heated quickly by a lower powered heater element. Heater element 24 may require less than 1000 watts to maintain an ironing temperature and ironing performance. Ironing temperatures may range from room temperature to about 200° C. Ironing temperature selections are typically from about 60-200° C. (150-400° F.).

The heater element may also be designed to comprise more than one heating zone. Heater element 24 may have a front end zone and two other zones for the heel side of sole plate 20. Each zone may be controlled independently in order to provide heat to where needed. Any number and/or configuration of zones may be implemented as beneficial in deferent iron designs.

According to still another aspect of the invention, electric steam iron 10 may be a completely cordless iron. Power may be generated by an alternative power source such as batteries or fuel cell. Capacitors may be used to store energy for quick release to the soleplate. Because the soleplate has the ability to heat up very quickly, energy released from one or more capacitors may be sufficient to heat the soleplate for a desired application. Capacitors may be recharged slowly over time and then released quickly for immediate heating of the soleplate.

Figure 9:
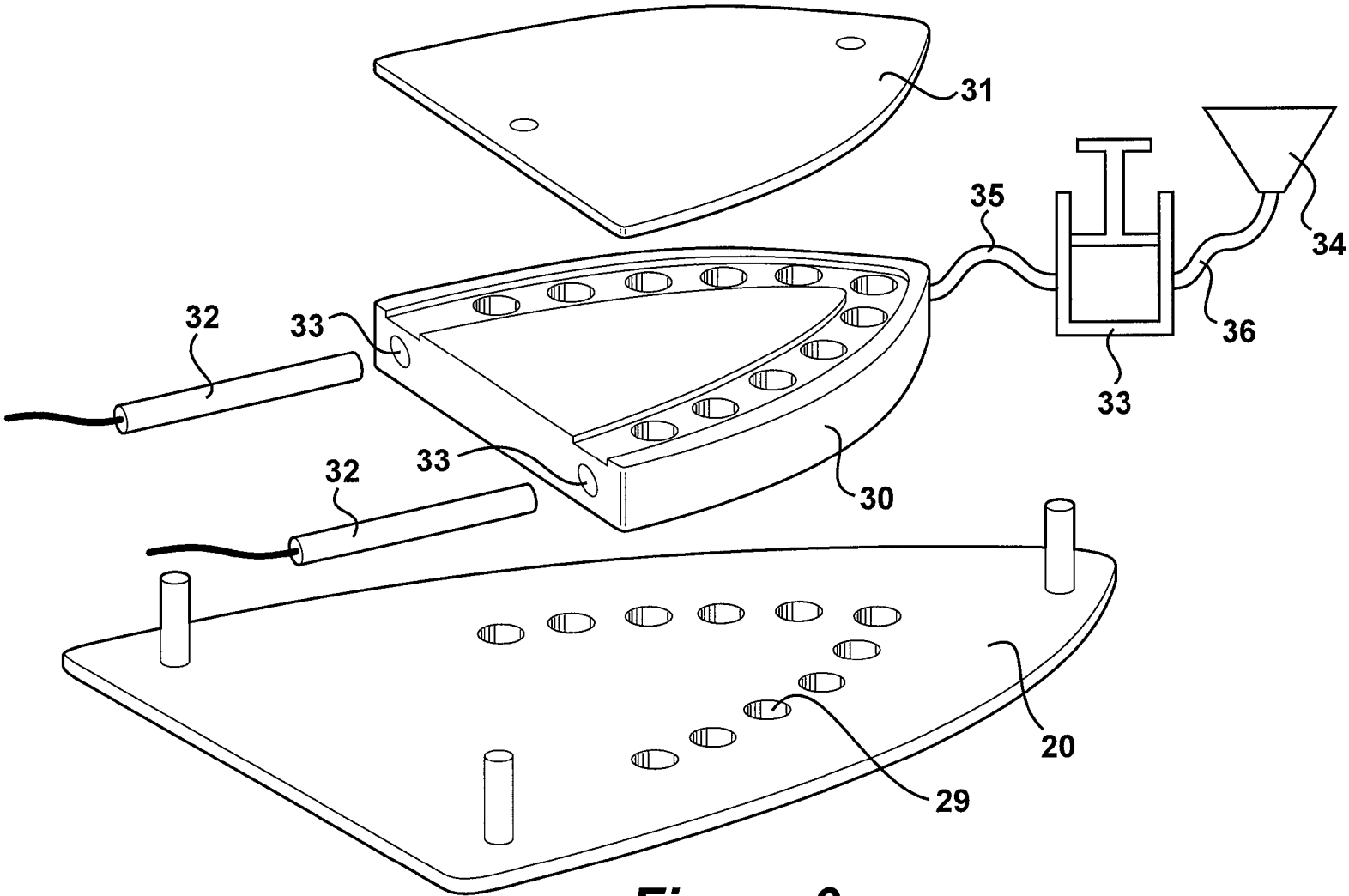
FIG. 9 illustrates an exploded, perspective view of soleplate, seam boiler, pump and reservoir embodiments of the invention.

Referring to FIG. 9, an exploded, perspective view is shown of soleplate 20, steam boiler 30, boiler lid 31 and boiler elements 32. Soleplate 20 is a generally flat structure that provides a contact surface for pressing fabric materials. In a midsection of soleplate 20, there may be a plurality of steam holes 29 extending therethrough so as to allow passage of steam. Steam boiler 30 is positioned adjacent soleplate 20 over the plurality of steam holes 29 so that steam discharged from steam boiler 30 is directed to steam holes 29. Boiler lid 31 is positioned on steam boiler 30 opposite soleplate 20. Steam boiler 30 has two element holes 33 in its backside into which two boiler elements 32 are inserted.

Steam generating fluid, such as water, is supplied to steam boiler 30 from reservoir 34. Reservoir 34 supplies fluid to pump 33 via conduit 36. Pump 33 injects water into steam boiler 30 via conduit 35. Pump 33 may be manually or automatically operated. For example, a manual pump may allow a user to inject fluid into the boiler only when a spurt of steam is desired for application to a fabric. As shown in FIG. 1, iron 10 may comprises steam surge button 14 for communication with pump 33 to provide a surge of steam. Alternatively, an automatic pump may be used to deliver a steady stream of fluid to the boiler for constant steam generation. The amount of fluid delivered to the boiler may be regulated to ensure that all of the fluid is boiled into steam so as to prevent drops of liquid coming into contact with the fabrics being ironed. Temperature may also be regulated to ensure maximum energy in order to get steam with out water droplets. Any device or process known to persons of skill may be used to deliver fluid to steam boiler 30.

Figure 10:
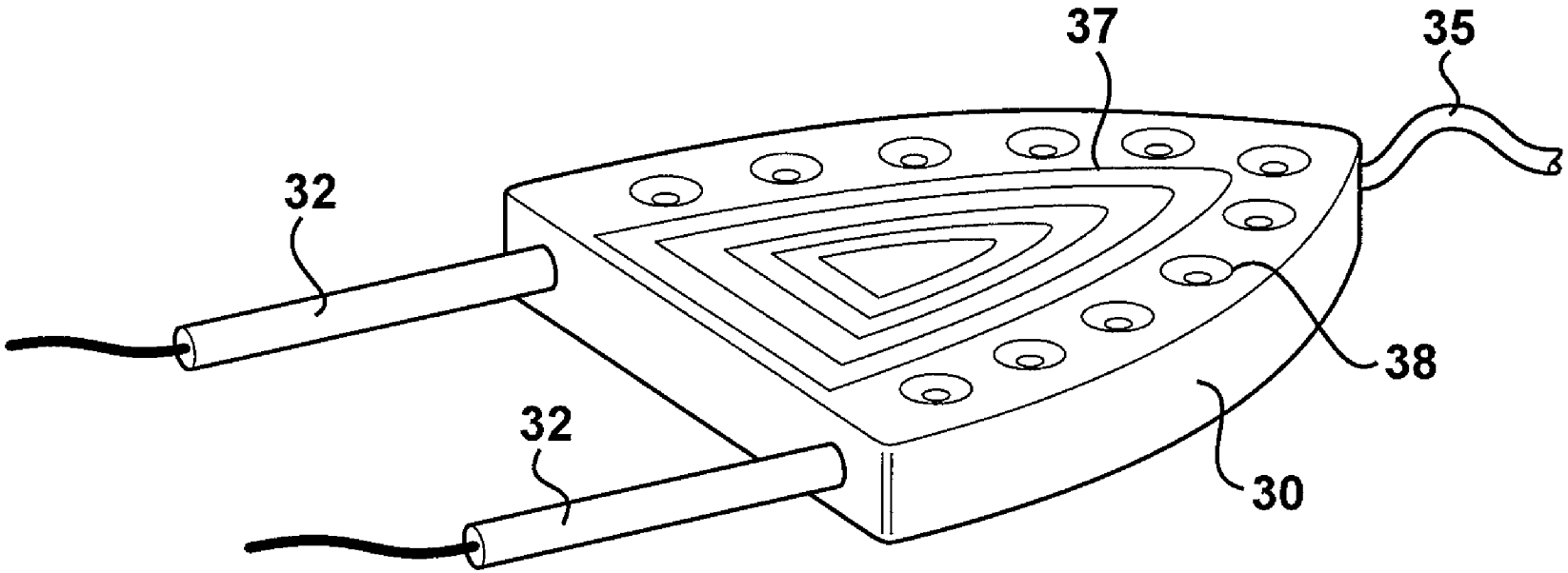
FIG. 10 is a perspective view of a boiler embodiment of the invention.

FIG. 10 illustrates a perspective view of a steam boiler of the present invention. Alternate design can be two similar halves that are die casted with internal fins. Then united in a separate process combined into one assembly with internal features. Steam boiler 30 may have boiler elements 32 and a fluid supplying conduit 35. Steam boiler 30 may also have fins 37 and steam vents 38. Fins 37 may dissipate heat more evenly within the boiler and created greater surface area for contacting fluid so as to more efficiently turn boil the fluid into steam. Steam vents 38 extend through the boiler to communicate steam from inside the boiler to steam holes 29 in soleplate 20 (see FIG. 9). Alternatively, the steam boiler can be coated internally to facilitate the creation of steam. Coatings like Ludox (colloidal silica) can be used.

Depending on the particular embodiment of the invention, the generation of steam may be done by a steam boiler that is integrated with the sole plate or it may be generated by a separate, independently controlled steam boiler, either of which may use a multitude of heating technologies in order to produce the steam. The steam boiler may be a casted metal part with either imbedded calrods or another suitable heat source to elevate the chamber's temperature to the point of generating the steam. In embodiments of the invention where the steam boiler is separate from the sole plate, steam may be generated by a different heating element. In this case, a user may steam at any fabric setting, including with the sole plate OFF. When the sole plate is OFF and the separate steam boiler is operational, the iron functions as a garment steamer. Further, the separate steam generator may allow adjustment of the amount of steam to be dispersed, independent of the temperature of the sole plate. For example, the iron may be set to a low steam rate for some garments and a higher steam rate for others, regardless of the temperature of the sole plate.

Where it is desirable to independently control the temperature of the soleplate while generating steam, independent heat sources may be applicable. A steam boiler may be heated to 100° C. or greater so as to generated steam. At the same time, the soleplate may only be heated to a temperature between room temperature and 100° C. In some embodiments of the invention, independent temperature control may be accomplished by separate heat sources, one for the steam boiler and the other for the soleplate. In other embodiments of the invention, independent temperature control may be accomplished by a single heat source and the amount of heat communicated to the steam boiler and soleplate are regulated, respectively. For example, the heat source may be placed immediately proximate the steam boiler so that the greatest amount of heat is communicated to the steam boiler. An insulation layer may be placed between the steam boiler/heat source combination and the soleplate, wherein the insulation layer is controlled to regulate the amount of heat energy communicated to the soleplate from the steam boiler/heat source combination.

The alternate configurations for the steam boiler can be utilizing other heat sources to generate the steam. These may be Infrared type, mica card heaters, or heater cartridges. The heating structures described above for heating the soleplate may also be utilized to heat up the steam boiler.

Electric steam iron 10 may also comprise a user sensor. Because the iron may have the ability to heat up very rapidly, the iron may be OFF whenever a user is not actively using it. Through a sensing scheme, whenever the iron is not interacted upon for a very short period of time, it may be turned OFF automatically. Immediately upon interaction by a user, the iron may be turned ON automatically. Any known user sensor may be implemented to control the application of heat to the sole plate and/or the steam boiler. The user sensor may be a user presence type. For example, the iron may turn OFF when the user releases the handle area. Then upon the user grabbing the handle area, the iron may turn ON and reach ironing temperature almost immediately. By automatically turning the iron ON and OFF with each use, the iron may be more energy efficient.

It will be appreciated that while the disclosure is particularly described in the context of fabric irons, the apparatuses, techniques, and methods disclosed herein may be similarly applied in other contexts. In particular, the invention may be applied to heat any flat surface such as warming plates, water kettles, coffee makers, griddles, etc. Additionally, it should be understood that various changes, substitutions and alterations can be made herein without departing from the spirit and scope of the disclosure as illustrated by the following claims.

What is claimed is:

1. A method for controlling the temperature of a soleplate of an iron, the method comprising:

energizing a heater element associated with the soleplate, wherein heat energy is transferred from the heater element to the soleplate;

providing the soleplate with a first insulating film adhered to a first side of a heater element via a first adhesive layer, a first side of a second insulating film adhered to a second side of the heater element via a second adhesive layer, and an ironing plate adhered to a second side of the second insulating film via a third adhesive layer wherein the first, second, and third adhesive layers are distinct and discrete layers from the first and second insulating films; and wherein the first and second adhesive layers are two separate adhesive layers adhering to the first and second sides of the heater element, respectively.

2. A method according to claim 1, further comprising cooling the soleplate from a temperature of greater than 100° C. to 60° C. in less than 4.5 minutes.

3. A method according to claim 1, wherein the energizing a heater element comprises energizing a foil.

4. A method according to claim 1, wherein the energizing a heater element comprises energizing an infrared source.

5. A method according to claim 1, wherein the energizing a heater element comprises maintaining an ironing temperature by energizing with less than 1000 watts.

6. A method according to claim 1, wherein the energizing a heater element comprises energizing more than one heating zone.

7. A method according to claim 1, further comprising sensing a user, wherein the sensing controls the energizing a heater element, such that when a user is sensed the heater element is energized and when no user is sensed the heater element is not energized.

8. A method according to claim 1, further comprising sensing a user, wherein the sensing controls the energizing a heater element, such that when a user is sensed the heater element is energized and when no user is sensed the heater element is energized by a relatively lesser amount.

9. A method according to claim 1, further comprising automatically stopping the energizing a heater element associated with the soleplate after a predetermined period of time.

10. A method for controlling an iron, the method comprising simultaneously:

heating a soleplate of the iron to a first temperature by heating a plurality of independently controlled heating zones; and heating a steam boiler of the iron to a second temperature, wherein the first and second temperatures are different.

11. A method according to claim 10, wherein the first temperature is less than or equal to 100° C. and the second temperature is greater than 100° C.

12. A method according to claim 10, further comprising independently controlling the first and second temperatures, respectively.

13. A method according to claim 10, wherein the heating a soleplate of the iron to a first temperature comprises applying less than 1000 watts to the soleplate.

14. A method according to claim 10, further comprising sensing a user, wherein the sensing controls the energizing a heater element, such that when a user is sensed the heater element is energized and when no user is sensed the heater element is not energized.

15. A method according to claim 10, further comprising sensing a user, wherein the sensing controls the energizing a heater element, such that when a user is sensed the heater element is energized and when no user is sensed the heater element is energized by a relatively lesser amount.

16. A method according to claim 10, further comprising automatically stopping the energizing a heater element associated with the soleplate after a predetermined period of time.

17. A device for removing wrinkles from fabric, the device comprising:

a heater element; and a soleplate comprising a first insulating film adhered to a first side of the heater element via a first adhesive layer, a first side of a second insulating film adhered to a second side of the heater element via a second adhesive layer, and an ironing plate adhered to a second side of the second insulating film via a third adhesive layer;

wherein the first, second, and third adhesive layers are distinct and discrete layers from the first and second insulating films; and wherein the first and second adhesive layers are two separate adhesive layers adhering to the first and second sides of the heater element, respectively.

18. A device according to claim 17, wherein the soleplate comprises a polyimide material.

19. A device according to claim 17, wherein the heater element is integrated with the soleplate.

20. A device according to claim 17, wherein the heater element is proximate the soleplate.

21. A device according to claim 17, wherein the heater element comprises a foil.

22. A device according to claim 17, wherein the heater element comprises a thickness smaller than ⅙ a width.

23. A device according to claim 17, wherein the heater element comprises a thickness between 0.05 mm and 0.15 mm, and wherein the heater element comprises a width between 1 mm and 5 mm.

24. A device according to claim 17, wherein the heater element is an infrared source.

25. A device according to claim 17, further comprising a rib in mechanical communication with the soleplate, wherein the rib structurally supports the soleplate.

26. A device according to claim 17, further comprising a backing in mechanical communication with the soleplate, wherein the backing structurally supports the soleplate.

27. A device according to claim 17, further comprising a user sensor, wherein the user sensor controls the heater element, such that when a user is sensed the heater element is energized and when no user is sensed the heater element is not energized.

28. A device according to claim 17, further comprising a user sensor, wherein the user sensor controls the heater element, such that when a user is sensed the heater element is energized and when no user is sensed the heater element is energized by a relatively lesser amount.

29. A device according to claim 17, further comprising an auto-OFF module, wherein the auto-OFF module automatically stops the energizing a heater element associated with the soleplate after a predetermined period of time.

30. A device according to claim 17, further comprising a battery power supply in electrical communication with the heater element, wherein the device is a cordless device.

31. A device for removing wrinkles from fabric, the device comprising:

a soleplate comprising a steam hole;

a soleplate heater element associated with the soleplate so as to primarily heat the soleplate;

a steam boiler in fluid communication with the steam hole of the soleplate; and a boiler heater element associated with the steam boiler so as to primarily heat the steam boiler;

wherein the soleplate comprises a first insulating film adhered to a first side of the soleplate heater element via a first adhesive layer, a first side of a second insulating film adhered to a second side of the soleplate heater element via a second adhesive layer, and an ironing plate adhered to a second side of the second insulating film via a third adhesive layers;

wherein the first, second, and third adhesive layers are distinct and discrete layers from the first and second insulating films; and wherein the first and second adhesive layers are two separate adhesive layers adhering to the first and second sides of the heater element, respectively.

32. A device according to claim 31, wherein the soleplate comprises a polyimide material.

33. A device according to claim 31, wherein the soleplate heater element is integrated with the soleplate.

34. A device according to claim 31, wherein the soleplate heater element is proximate the soleplate.

35. A device according to claim 31, wherein the soleplate heater element is a foil.

36. A device according to claim 31, wherein the soleplate heater element comprises a thickness smaller than ⅙ a width.

37. A device according to claim 31, wherein the soleplate heater element comprises a thickness between 0.05 mm and 0.15 mm, and wherein the heater element comprises a width between 1 mm and 5 mm.

38. A device according to claim 31, wherein the heater element is an infrared source.

39. A device according to claim 31, further comprising a rib in mechanical communication with the soleplate, wherein the rib structurally supports the soleplate.

40. A device according to claim 31, further comprising a rib in mechanical communication with the soleplate, wherein the rib structurally supports the soleplate and the rib is formed from the same material as the soleplate material.

41. A device according to claim 31, further comprising a backing in mechanical communication with the soleplate, wherein the backing structurally supports the soleplate.

42. A device according to claim 31, further comprising a soleplate temperature control in communication with the soleplate heater element and a steam boiler temperature control in communication with the boiler heater element, wherein the soleplate temperature control and the boiler temperature control operate independently of each other.

43. A device according to claim 31, further comprising a user sensor, wherein the user sensor controls the heater element, such that when a user is sensed the heater element is energized and when no user is sensed the heater element is not energized.

44. A device according to claim 31, further comprising a user sensor, wherein the user sensor controls the heater element, such that when a user is sensed the heater element is energized and when no user is sensed the heater element is energized by a relatively lesser amount.

45. A device according to claim 31, further comprising an auto-OFF module, wherein the auto-OFF module automatically stops the energizing a heater element associated with the soleplate after a predetermined period of time.

46. A device according to claim 31, further comprising a battery power supply in electrical communication with the soleplate heater element and the boiler heater element, wherein the device is a cordless device.

47. A device for removing wrinkles from fabric, the device comprising:

a soleplate comprising a steam hole;

a steam boiler in fluid communication with the steam hole of the soleplate;

a heater for heating both the soleplate and the steam boiler;

an insulating layer between the heater and the soleplate; and a soleplate temperature control that controls the thermal capabilities of the insulating layer to control the insulating capacity of the insulating layer.

48. A device according to claim 47, wherein the soleplate temperature control allows independent temperature control of the soleplate and the steam boiler.

49. A device for removing wrinkles from fabric, the device comprising:

a heater element;

an ironing plate;

a first insulating layer adhered to a first side of the heater element via a first adhesive layer;

a second insulating layer having:

a first side adhered to a second side of the heater element via a second adhesive layer, and a second side adhered to the ironing plate via a third adhesive layer;

wherein the first, second, and third adhesive layers are distinct and discrete layers from the first and second insulating films; and wherein the first and second adhesive layers are two separate adhesive layers adhering to the first and second sides of the heater element, respectively.

50. A device for removing wrinkles from fabric, the device comprising:

an ironing plate;

a heater element having a first side facing toward the ironing plate and a second side facing away from the ironing plate;

a first insulating layer positioned between the ironing plate and the first side of the heater element; and a second insulating layer positioned adjacent the second side of the heater element facing away from the ironing plate;

wherein the heater element comprises an elongated flat strand arranged in an undulating manner to form one continuous, electrically resistant, heat generating coil.

51. A device for removing wrinkles from fabric, the device comprising:

an ironing plate;

a heater element having a first side facing toward the ironing plate and a second side facing away from the ironing plate;

an insulating layer adhered to the second side of the heater element facing away from the ironing plate;

wherein the heater element comprises an elongated flat strand arranged in an undulating manner to form one continuous, electrically resistant, heat generating coil.

* * * * *